US006719120B2

(12) United States Patent
Kato

(10) Patent No.: US 6,719,120 B2
(45) Date of Patent: Apr. 13, 2004

(54) BILL RECEIVING/DISPENSING MACHINE

(75) Inventor: Riichi Kato, Nagoya (JP)

(73) Assignee: Hitachi, Ltd., Tokyo (JP)

( * ) Notice: Subject to any disclaimer, the term of this patent is extended or adjusted under 35 U.S.C. 154(b) by 180 days.

(21) Appl. No.: 10/024,486

(22) Filed: Dec. 21, 2001

(65) Prior Publication Data

US 2002/0092727 A1 Jul. 18, 2002

(30) Foreign Application Priority Data

Dec. 25, 2000 (JP) ..... 2000-392052

(51) Int. Cl.[7] ..... G07F 7/04
(52) U.S. Cl. ..... 194/206; 194/350
(58) Field of Search ..... 194/206, 207, 194/350; 209/534; 235/379

(56) References Cited

U.S. PATENT DOCUMENTS

| | | | | |
|---|---|---|---|---|
| 5,167,411 A | | 12/1992 | Isobe | |
| 5,740,897 A | * | 4/1998 | Gauselmann | 194/206 |
| 5,984,177 A | * | 11/1999 | Do et al. | 235/379 |

FOREIGN PATENT DOCUMENTS

| | | | |
|---|---|---|---|
| DE | 19802916 | A1 | 7/1999 |
| EP | 1008965 | A1 | 6/2000 |
| JP | 9-44723 | | 2/1997 |
| JP | 9044723 | A | 2/1997 |
| JP | 10-172025 | | 6/1998 |
| JP | 2000-172946 | | 6/2000 |

* cited by examiner

*Primary Examiner*—F. J. Bartuska
(74) *Attorney, Agent, or Firm*—McDermott, Will & Emery

(57) ABSTRACT

It is an object to provide a bill receiving/dispensing machine in view of service of securing a quick response to a user in operator's operation when a failure such as a bill jam occurs during user's operation, and security of cash controlling, as well as usual supply and collection of a bill to and from a bill storing room. In order to achieve the object, the machine is constituted from an upper unit including a receiving/dispensing port, a bill identifying portion, a temporary storing room and an upper bill conveying passage, and a lower unit including a bill storing room and a lower bill conveying passage. The upper unit includes a slide mechanism which can be pulled out both forward and backward. There is also provided a connecting conveying passage which connects a bill conveying passage in the upper unit with a bill conveying passage in the lower unit.

27 Claims, 10 Drawing Sheets

BILL RECEIVING/DISPENSING MACHINE

BACKGROUND OF THE INVENTION

The present invention relates to a bill receiving/dispensing machine for receiving and/or dispensing a bill, and more particularly to a bill receiving/dispensing machine in which supplement and collection of bills can be easily executed, a quick response can be made when a jam occurs, and security is improved.

A bill receiving/dispensing machine installed in an automatic teller machine used in, for example, a financial institution generally includes a receiving/dispensing port for inserting a bill by a user, for sending out the inserted bill and for ejecting a bill to a user, a bill identifying portion for identifying a bill, and a bill conveying passage passing through the bill identifying portion for conveying a bill. The machine also includes a temporary storing room for temporarily storing the inserted bill, and a recycle room for storing and sending out a bill both for receiving and payment. Further, the machine includes a reject room for storing a rejected bill which did not satisfy a predetermined criteria in the bill identifying portion, a supplying/collecting room for sending out a bill to the recycle room so as to fill up there and for storing a bill collected from the recycle room, and the like.

As an example of an inner layout of the bill receiving/dispensing machine, there is proposed a bill mechanism which is divided into upper and lower portions. See JP-A-9-44723 specification.

BRIEF SUMMARY OF THE INVENTION

As an automatic teller machine becomes widespread, a bill receiving/dispensing machine which improves convenience of a user, saves labor of an operator (a person in charge of the machine), and improves security becomes desired.

There have been two types of methods of operating an automatic teller machine by an operator in accordance with an installed location of the machine: one is a front operation type, and the other is a rear operation type. The front operation type machine is operated from the front side of the machine by the operator, and thus can save a space since the operation space is common to a user and the operator. Contrary, the rear operation type machine is operated from the rear side of the machine by the operator and thus requires the operation space for the operator behind a rear door of the machine, but provides a private space only for the operator, which is separated from the operation space for an user, so that security is improved.

The operator's operation of the bill receiving/dispensing machine is usually to supply a bill to a bill storing room and collect a bill from the bill storing room. Further, when a failure such as bill jamming occurs in user's operation, it is necessary to quickly respond to the failure, remove the bill in the bill receiving/dispensing machine, repay the bill to the user, and reboot the machine.

Especially in a deposit transaction, since an old bill owned by various users may be inserted, the bill may be folded or broken, or since a foreign matter other than a coin and a bill may be inserted, there has been a problem that a failure such as the bill jamming is apt to occur. Further, in this case, since the jamming bill belongs to the user before completing the transaction, the operator has to return the bill to the user.

If the failure such as the bill jam occurs in a dispense transaction, the operator has to open the bill storing room holding a large amount of bills when removing the jamming bill, and the jamming bill does not belong to the user in this case, and thus, it is desirable, in view of the security, to quickly deal with the failure in a blind place to the user, and to quickly reboot the system.

Accordingly, it is desirable that the machine can consider service on the basis of a quick response to the user, and security in cash controlling, in view of the operator's operation when such failure occurs.

The above described conventional example has not been in consideration of operational property when such failure occurs while being in consideration of the operator's operational property and security by dividing the bill receiving/dispensing machine into upper and lower portions and installing a bill storing room in a strongbox housing.

An object of the invention is to provide a bill receiving/dispensing machine which is given consideration of not only usual supplement of a bill to a bill storing room and collection of a bill from the bill storing room, but also both of service by a quick response to the user and security in cash controlling in view of the operator's operation when the failure such as the bill jam occurs during the user operation.

In order to achieve the above described object, the present invention provides a bill receiving/dispensing machine (1) including: a receiving port, dispensing port, or receiving/dispensing port (20), a bill identifying portion (30), a temporary storing room (40), a bill storing room (60, 70, 80, 81), and a bill conveying passage, in which the machine is constituted by an upper unit (upper bill mechanism 1*a*) including the receiving port, dispensing port, or receiving/dispensing port (20), the bill identifying portion (30), the temporary storing room (40), and an upper bill conveying passage (50; 501*a* to 501*j*), and a lower unit (lower bill mechanism 1*b*) including the bill storing room (60, 70, 80, 81), and a lower bill conveying passage (90; 901*a* to 901*e*), the lower unit (1*b*) is installed in a strongbox housing (106) made of a thick iron plate or the like, the lower unit (1*b*) includes a slide mechanism (152) to be pulled out backward from the strongbox housing, and the upper unit (1*a*) includes a slide mechanism (151) to be pulled out both forward and backward above the strongbox housing. The strongbox housing (106) is provided with a connecting conveying passage which connects the bill conveying passage in the upper unit (1*a*) and the bill conveying passage in the lower unit.

As a result, an operator operates the bill storing room in the lower unit by opening the strongbox housing of which security is highly ensured from the rear side of the machine for usual supplying and collecting and dispensing operations. When a failure such as a bill jam occurs in a deposit transaction, the jamming bill may remain in the upper unit, namely in the receiving/dispensing port, the temporary storing room, and the bill conveying passage connecting those, and thus the operator can pull out the upper unit at the front side of the machine, remove the jamming bill, and reboot the machine. At this time, since the lower unit holding a large amount of bills is placed in the strongbox housing, the security is ensured.

An embodiment of the present invention will be hereinafter described in detail with reference to the drawings.

DETAILED DESCRIPTION OF THE INVENTION

Figure 1:
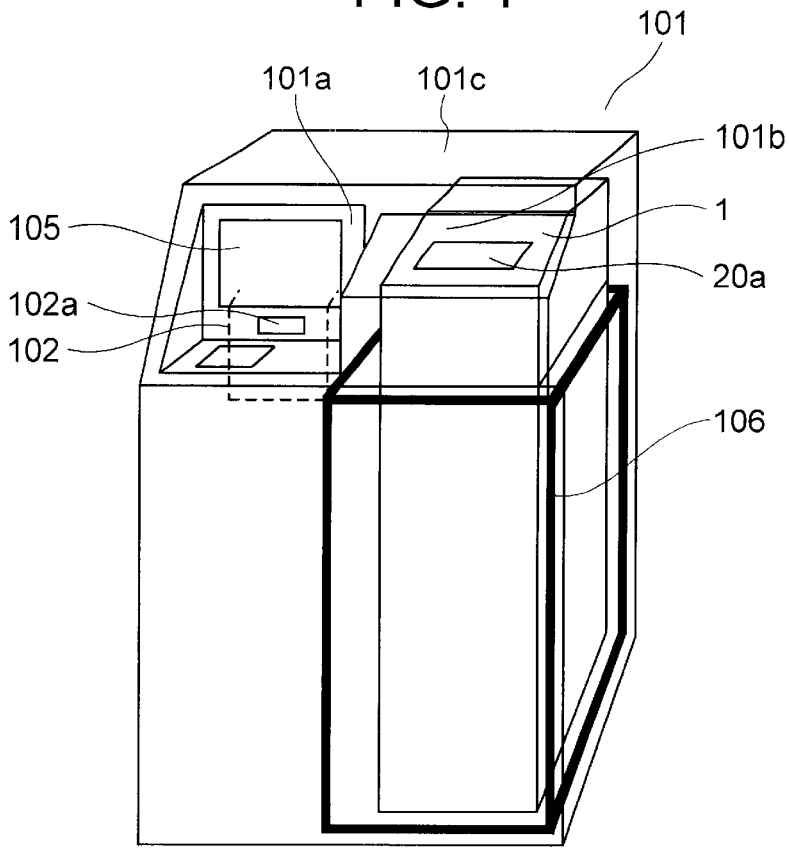
FIG. 1 is a perspective view showing an appearance of an automatic teller machine.

FIG. 1 is a perspective view of an appearance of an automatic teller machine.

The automatic teller machine 101 comprises, in an inner left portion thereof, a card and bank statement processing mechanism 102 which is communicated with a card slot 102*a* provided in an upper front plate 101*a*, deals with a card of a user, and prints and ejects a bank statement, and a customer operating part 105 for display and input of contents of transactions. The whole automatic teller machine 101 is surrounded by a machine housing 101*c*. The automatic teller machine 101 comprises, in an inner right portion thereof, a bill receiving/dispensing machine 1 for handling a bill, which is provided with a bill slot 20*a* in a front plate 101*b* inclined at the upper portion thereof. Bill storing portions below the bill receiving/dispensing machine 1 are surrounded by a strongbox housing 106 made of a thick iron plate or the like having a thickness of some ten mm, unlike the machine housing 101*c*. The machine housing 101*c* also has a rigid housing structure, and the strongbox housing 106 has a more rigid structure for increasing security. The automatic teller machine 101 deals with transactions such as deposit, dispense, transfer by the user using a card, bill, and bank statement.

Figure 2:
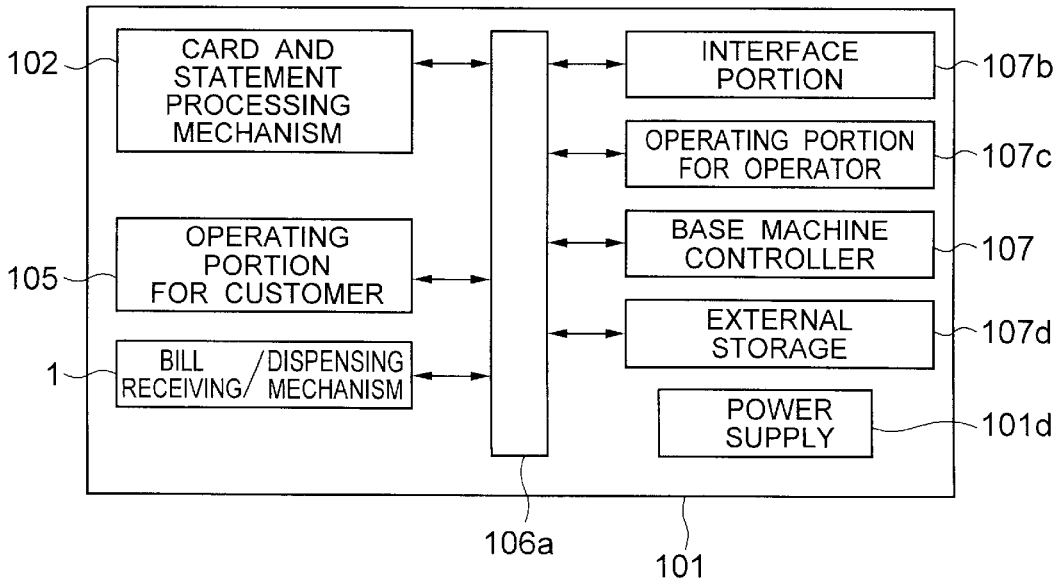
FIG. 2 is a block diagram showing a control relationship of the automatic teller machine.

FIG. 2 is a control block diagram showing a control relationship of the automatic teller machine 101.

The card/statement processing mechanism 102, bill receiving/dispensing machine 1, and the customer operating part 105 held in the automatic teller machine 101 are connected to a base machine controller 107 via a bus 106*a*, and carry out necessary operation under control of the base machine controller 107. The base machine controller 107 is also connected to an interface 107*b*, an operator's operating part 107*c*, an external storage 107*d* via the bus 106*a*, and exchanges necessary data therewith, however, those have no direct relationship with features of the invention and thus detailed descriptions thereof will be omitted. Reference numeral 101*d* in FIG. 2 denotes a power supply for supplying power to the respective mechanisms and components.

Figure 3:
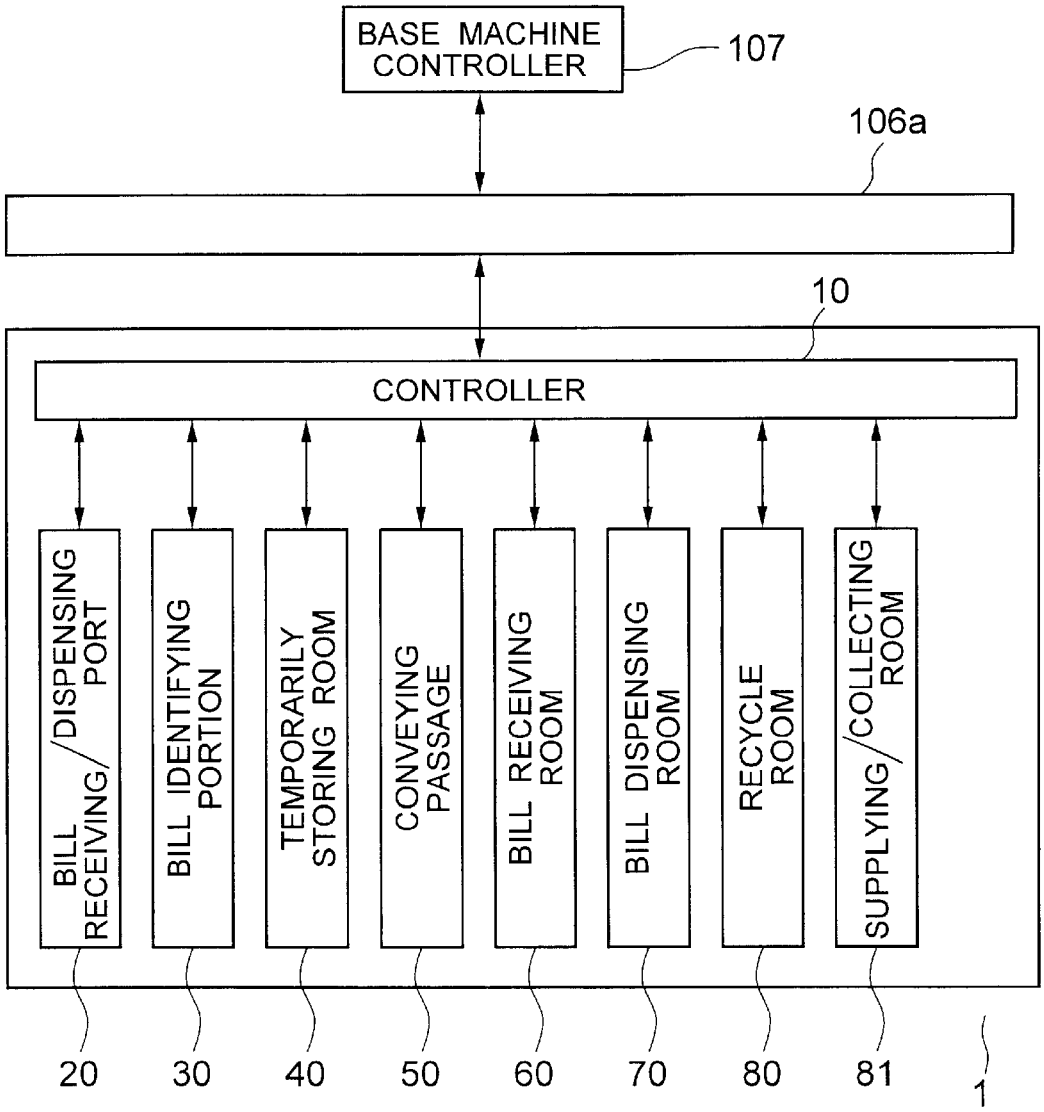
FIG. 3 is a block diagram showing a control relationship of a bill receiving/dispensing machine.

FIG. 3 is a control block diagram showing a control relationship of the bill receiving/dispensing machine 1 located in the automatic teller machine 101 in FIG. 1.

A controller 10 of the bill receiving/dispensing machine 1 is connected to the base machine controller 107 of the automatic teller machine 101 via the bus 106*a* so as to control the bill receiving/dispensing machine 1 in accordance with a command from the base machine controller 107 and detection of a state of the bill receiving/dispensing machine 1, and transmits the state of the bill receiving/dispensing machine 1 to the base machine controller 107 as required.

The bill receiving/dispensing machine 1 also comprises a driving motor, an electromagnetic solenoid, a sensor or the like (not shown) for each unit (a bill receiving/dispensing port 20, a bill identifying portion 30, a temporary storing room 40, a conveying passage 50, a bill receiving room 60, a bill dispensing room 70, a recycle portion 80 and a supplying/collecting room 81), and drives and controls an actuator in accordance with a transaction mentioned below while monitoring the state by using the sensor.

Figure 4:
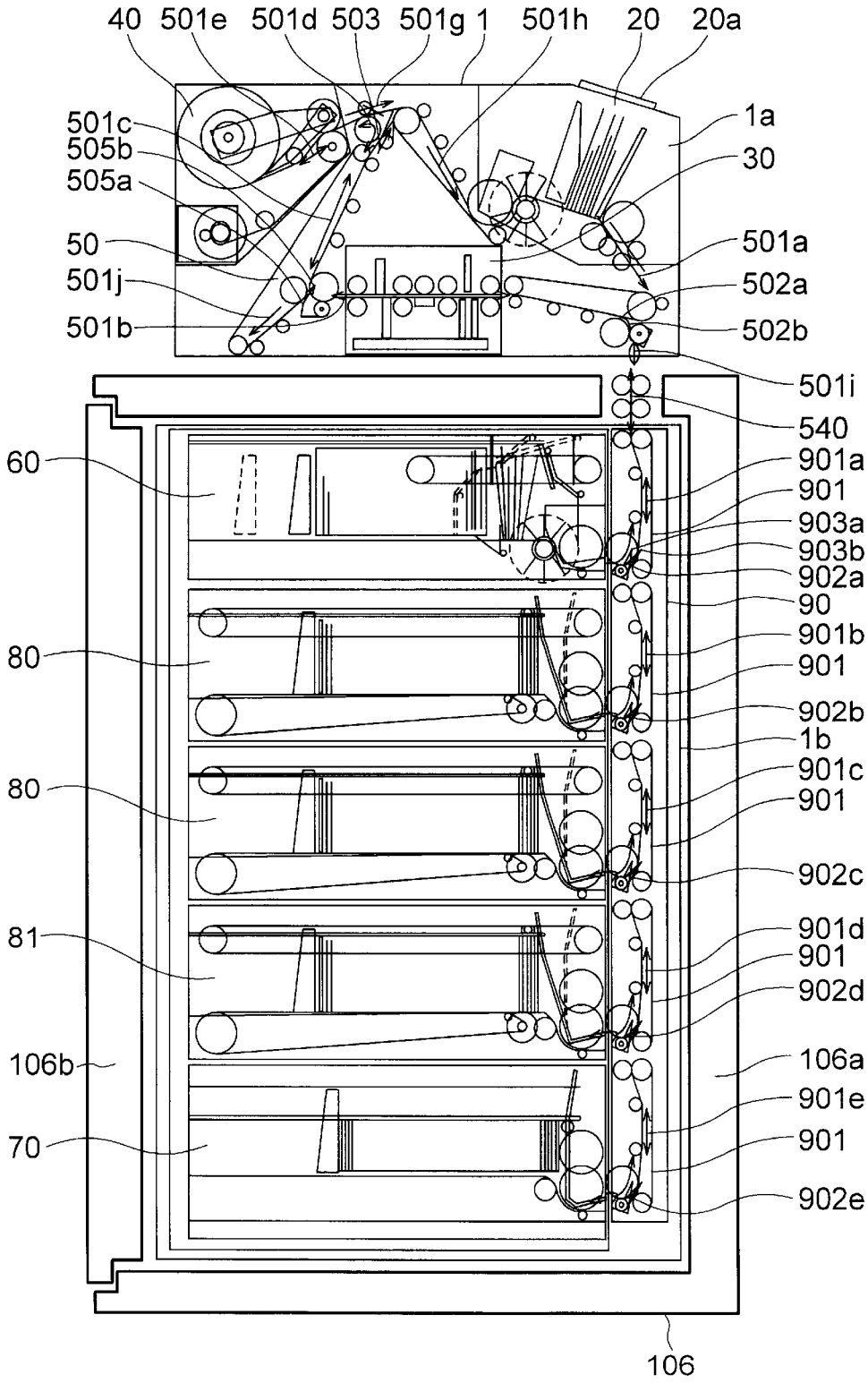
FIG. 4 is a side view of the bill receiving/dispensing machine.

FIG. 4 is a side view of the bill receiving/dispensing machine 1.

The bill receiving/dispensing machine 1 comprises the bill receiving/dispensing port 20 in and from which the user inserts and takes out the bill, the bill identifying portion 30 which identifies the bill, the temporary storing room 40 which temporarily holds the inserted bill before completing the transaction, a bill receiving room 60 which holds the bills after completing the deposit transaction, a bill dispensing room 70 which holds bills to be dispensed, two recycle rooms 80 both for receiving and dispensing a bill, the supplying/collecting room 81 which holds bills to be supplied to the recycle room 80 or bills collected from the recycle room 80, the conveying passages 50 (501*a* to 501*j*) which pass through the bill identifying portion 30 and convey the bills among the bill receiving/dispensing port 20, the temporary storing room 40, the bill receiving room 60, the bill dispensing room 70, the recycle room 80 and the supplying/collecting room 81, and the controller 10. The controller 10 is omitted from FIG. 4 (see FIG. 3).

The bill receiving/dispensing machine 1 is designed to be mainly divided into an upper bill mechanism 1*a* and a lower bill mechanism lb. The upper bill mechanism 1*a* comprises the bill receiving/dispensing port 20, the bill identifying portion 30, the temporary storing room 40, and the conveying passages 50 (501*a* to 501*j*). The lower bill mechanism 1*b* comprises the bill receiving room 60, the bill dispensing room 70, the recycle rooms 80, the supplying/collecting room 81 and the opening/closing conveying passages 90 (the bill conveying passages 901*a* to 901*e*) arranged in front of the respective storing portions. The conveying passages 50 (501*a* to 501*j*) in the upper bill mechanism 1*a* and the opening/closing conveying passages 90 (the bill conveying passages 901*a* to 901*e*) are divided into upper and lower portions, and a coupling conveying passage 540 is provided for connecting the conveying passages to one another, as apparent from the figure and the above description.

In this way, by dividing the bill receiving/dispensing machine 1 into the upper bill mechanism 1*a* and lower bill mechanism 1*b* mainly, it becomes possible to derive structural features mentioned below, for example to slide the upper bill mechanism 1*a* forward and backward of the machine easily. Further, by also dividing the conveying passages into the upper and lower portions, a specific effect is obtained which allows maintenance (also referred to maintenance management) for removing the jammed bill in the conveying passages.

The lower bill mechanism 1*b* is mounted in the strongbox housing 106 made of a thick iron plate with a thickness on the order of 50 mm. As described above, the lower bill mechanism 1*b* comprises the storing portions which hold a large amount of bills, that is, comprises the bill receiving room 60, the recycle rooms 80, or the like, and thus, by surrounding the mechanism by the thick iron plate, it is possible to respond to an unexpected state such as attack to the machine.

In order to connect the conveying passage 501*i* of the upper bill mechanism 1*a* made on an upper iron plate and the bill conveying passage 901*a* of the lower bill mechanism 1*b*, the coupling conveying passage 540 is provided in a corresponding position of the strongbox housing 106 which surrounds the lower bill mechanism 1*b*. A slit provided in the upper iron plate has a length so as to allow the bill to pass, and a width corresponding to a width of a conveying roller mounted so as to hold and send out the bill conveyed to the slit.

In the case that the lower bill mechanism 1*b* is designed not to be surrounded by the strongbox housing 106, it is not always necessary to prove the coupling conveying passage 540 if adopting a structure where the upper bill mechanism 1*a* is directly placed on the lower bill mechanism 1*b*. Driving sources (motors) for the conveying passages may be separately provided for the conveying passages 50 (501*a* to 501*j*) of the upper bill mechanism 1*a* and the opening/closing conveying passages 90 (conveying passages 910*a* to 901*e*) of the lower bill mechanism 1*b*, or a driving force may be transmitted by providing a gear between the coupling conveying passage 540 and bill conveying passage 901*a* and using a single driving source.

The conveying passages 50 (501*a* to 501*j*) of the upper bill mechanism 1*a* pass through the bill identifying portion 30 in two directions, and connect the bill receiving/dispensing port 20, the temporary storing room 40, the bill receiving room 60, the bill dispensing room 70, the recycle rooms 80, and the supplying/collecting room 81 to one another via conveying passages shown by arrows 501*a* to 501*j* and 901*a* to 901*e* (the bill conveying passages and the arrows are described with the same reference numerals for convenience). Single headed arrows show one way bill conveying passages through which the bills are conveyed only in the arrow direction, and double headed arrows show two way conveying passages which are switched to either way for each transaction operation of the bills for conveyance. Further, on branch points of the conveying passages 50, switching gates 502, 503, and five switching gates 902 are provided for switching the bill conveying directions as shown by characters such as "a" and "b" for each transaction operation. By using the bill receiving/dispensing machine 1 of the above structure, the user carries out deposit/dispense transaction, and the operator carries out supplying/collecting of the bills.

First, operation in the deposit transaction will be described.

In the deposit transaction, the bills inserted in the bill receiving/dispensing port 20 are separated one by one, and thereafter kinds and genuineness of the bills are identified in the bill identifying portion 30. The bills identified by the bill identifying portion 30 are temporarily stored in the temporary storing room 40 by switching the switching gate 503. In the case of bills which could not be identified by the bill identifying portion 30, bills generating inclination, or bills having unusual spacing therebetween (for example, overlapped bills), those are identified as bills to be rejected (hereinafter referred to as reject bills). The reject bills are not taken in the temporary storing room 40, and returned to and held in the bill receiving/dispensing port 20 to be returned to the user by switching the switching gate 503.

When an amount of the bills inserted by the user corresponds to an amount calculated by the machine, and the user confirms (OK) the deposit transaction, the bills temporarily held in the temporary storing room 40 are fed to an opposite direction in a sequence opposite to that of the holding operation, and pass through the bill identifying portion 30. Then, the bills having passed through the bill identifying portion 30 are stored in a designated storing portion by switching the switching gate 502 toward a direction 502*a* and by switching a switching gate 903 of either of the bill receiving room 60, the recycle rooms 80 or the reject portion 90 toward a shown direction 903*b*. The deposit transaction is thereby completed.

Next, operation in the dispense transaction processing will be described.

In the dispense transaction, a predetermined amount of bills are fed from each bill room for each kind of the bill in the bill dispensing room 70 and the recycle rooms 80 so as to be supplied to the bill identifying portion 30. The bill identifying portion 30 identifies the kinds of the bills. Then, the switching gate 503 is switched in such a manner that the bills are held in the bill receiving/dispensing port 20, the bills having passed through the bill identifying portion 30 are held in the bill receiving/dispensing port 20, and then a shutter on an upper surface of the bill slot 20*a* is opened to allow the user to take out the bills. When the user receives the bills in the storing portion, the dispense transaction is completed.

Next, operation for supplying the bills in the recycle room or for collecting the bills contrary from the recycle room will be described. The supplement and the collection can be achieved by conveying the bills between two of the supplying/collecting room 81, the temporary storing room 40, and the recycle rooms 80.

First, in the supplying operation, the bills are collectively set in the supplying/collecting room 81, and automatically stored in the recycle room 80 in the machine. In the collecting operation, the predetermined amount of bills are automatically collected from the recycle rooms 80, and held in the supplying/collecting rooms 81 in the case such that the recycle room 80 becomes full. That is, the collecting operation moves the bills in a direction opposite to that in the supplying operation.

The bill receiving/dispensing machine 1 structured as described above is mounted in the inner right portion of the automatic teller machine 101 as shown in FIG. 1.

Next, a configuration concerning the operability (the operational property) of the bill receiving/dispensing machine 1 for the operator will be described with reference to the drawings. Significant features of the bill receiving/dispensing machine 1 are that the upper bill mechanism 1*a* can be pulled out both forward and backward of the machine, and that the lower bill mechanism 1*b* of the machine can be pulled out backward.

Figure 5A:
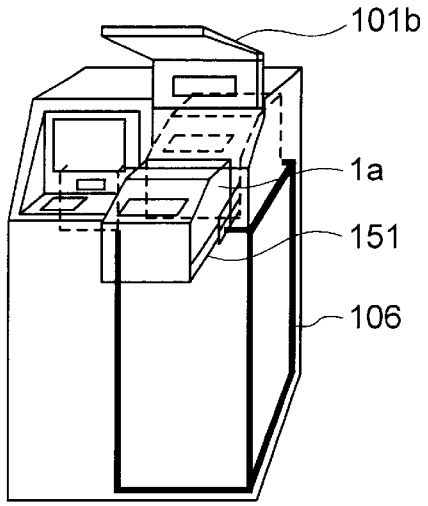
FIGS. 5A, 5B and 5C are views showing operation methods of the automatic teller machine in FIG. 1.
Figure 5B:
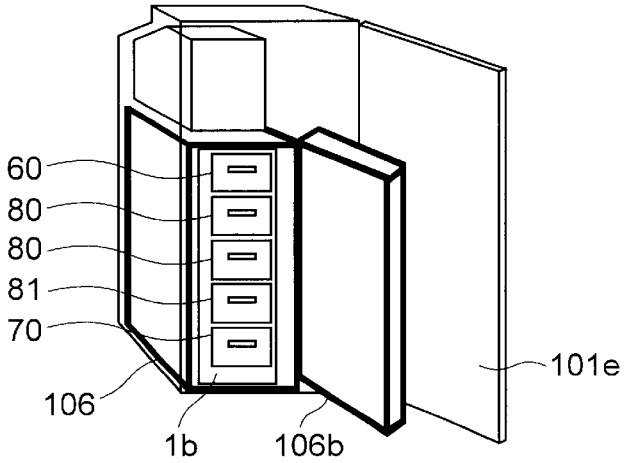
Figure 5C:
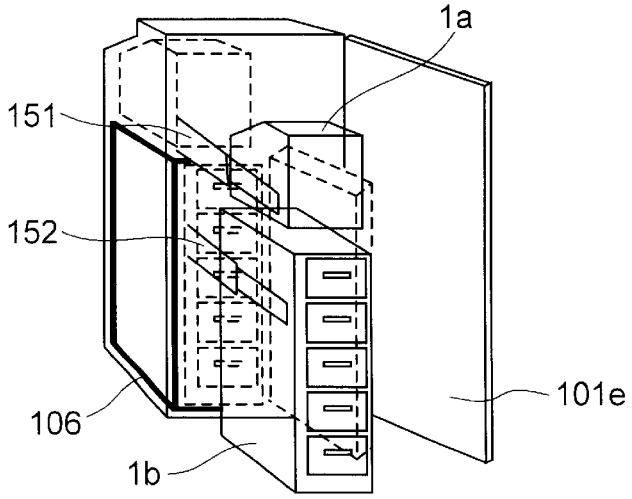
Figure 6:
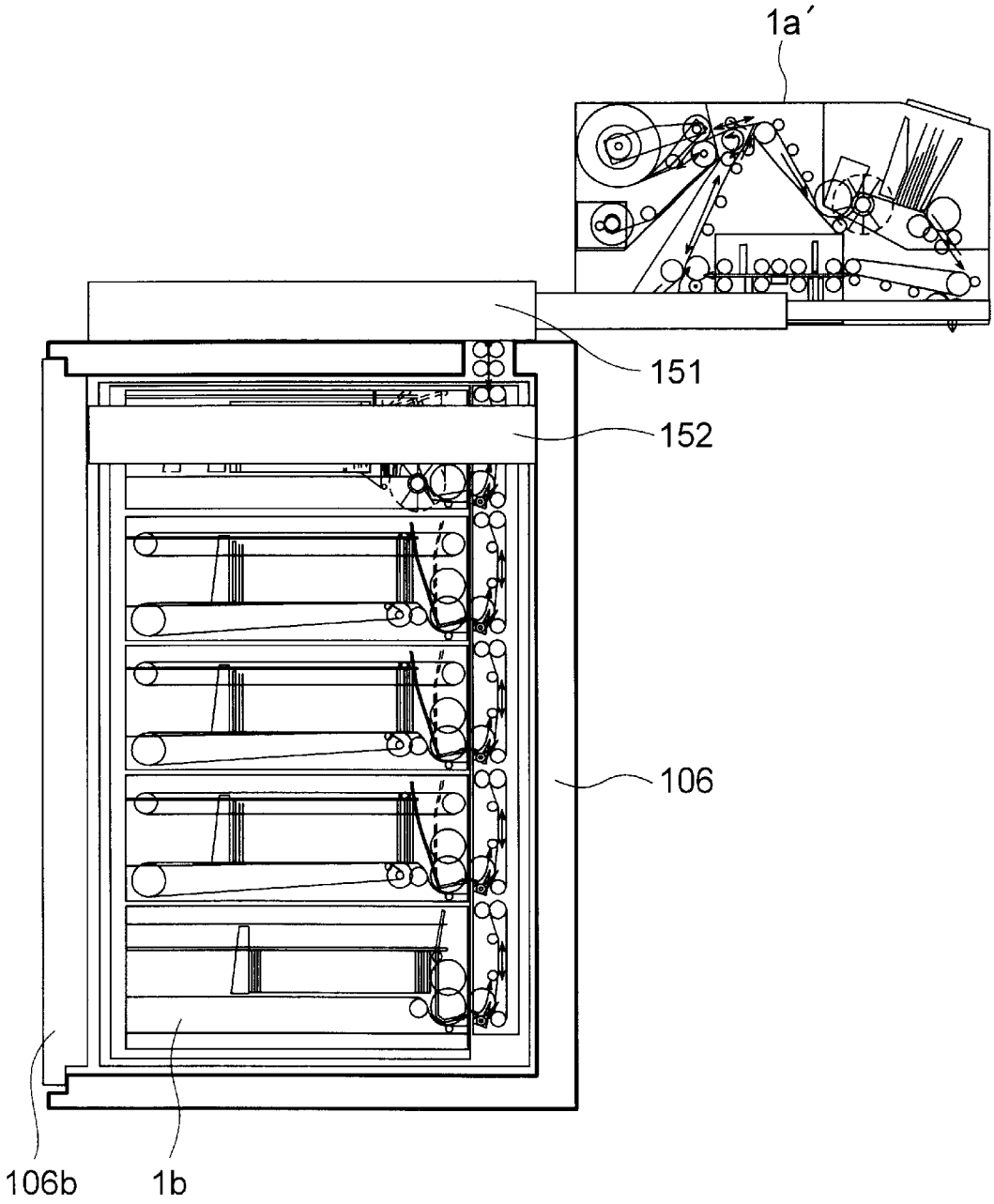
FIG. 6 is a side view where an upper bill mechanism is pulled out forward from the state in FIG. 4.

FIGS. 5 and 6 are views explaining the operation states of the automatic teller machine 101 and the bill receiving/dispensing machine 1.

As shown in FIG. 5A, when the upper bill mechanism 1*a* is pulled out toward the front side of the automatic teller machine 101, the operator or maintenance person releases a lock mechanism (described below) located in the front of the machine and lifts the front plate 101*b* covering the upper bill mechanism 1*a* so as to open a front surface of an upper portion of the machine. Then, a portion usually locking the upper bill mechanism 1*a* to the machine is released by a lock lever or the like, so that the upper bill mechanism 1*a* per se is released, and thereby the upper bill mechanism 1*a* can be designed to be pulled out forward along a slide rail mechanism 151.

On the other hand, when the upper bill mechanism 1*a* is pulled out toward the rear side of the machine, as shown in FIG. 5C, a lock mechanism of a rear door 101*e* is released so as to open a rear surface and to release a lock mechanism of the upper bill mechanism 1*a*, and thus the upper bill mechanism 1*a* can be designed to be pulled out backward of the machine along the slide rail mechanism 151.

When the lower bill mechanism 1*b* is pulled out from the rear of the machine, as shown in FIG. 5B, an unshown lock mechanism is released to open the rear door 101*e* of the machine housing 101*c*, and lock of a rear door 106*b* of the strongbox housing 106 is also released to be opened. Thus, the bill receiving room 60, the bill dispensing room 70, the recycle rooms 80, the supplying/collecting room 81 included in the lower bill mechanism 1*b* are allowed to be pulled out. In this way, the lower bill mechanism 1*b* is surrounded by the strongbox housing 106 made of the thick iron plate in view of security as described above, and having a double structure of the rear doors 101*e* and 106*b*. Like the upper bill mechanism 1*a*, the lower bill mechanism 1*b* is also provided with a slide rail mechanism so as to be easily pulled out by the operator, and is designed to be pulled out backward of the machine along the slide rail mechanism 152.

Figure 7:
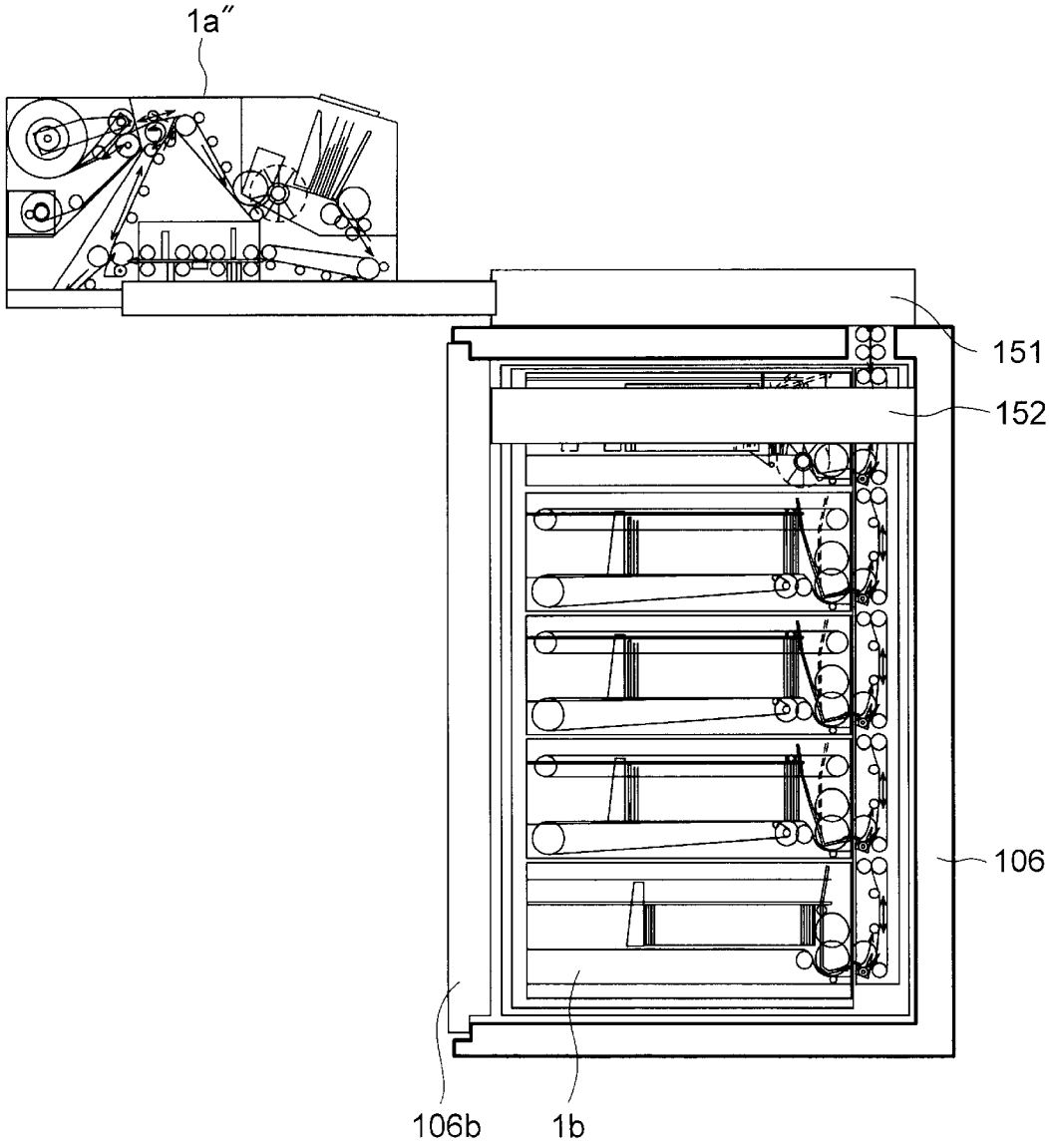
FIG. 7 is a side view where the upper bill mechanism is pulled out backward from the state in FIG. 4.
Figure 8:
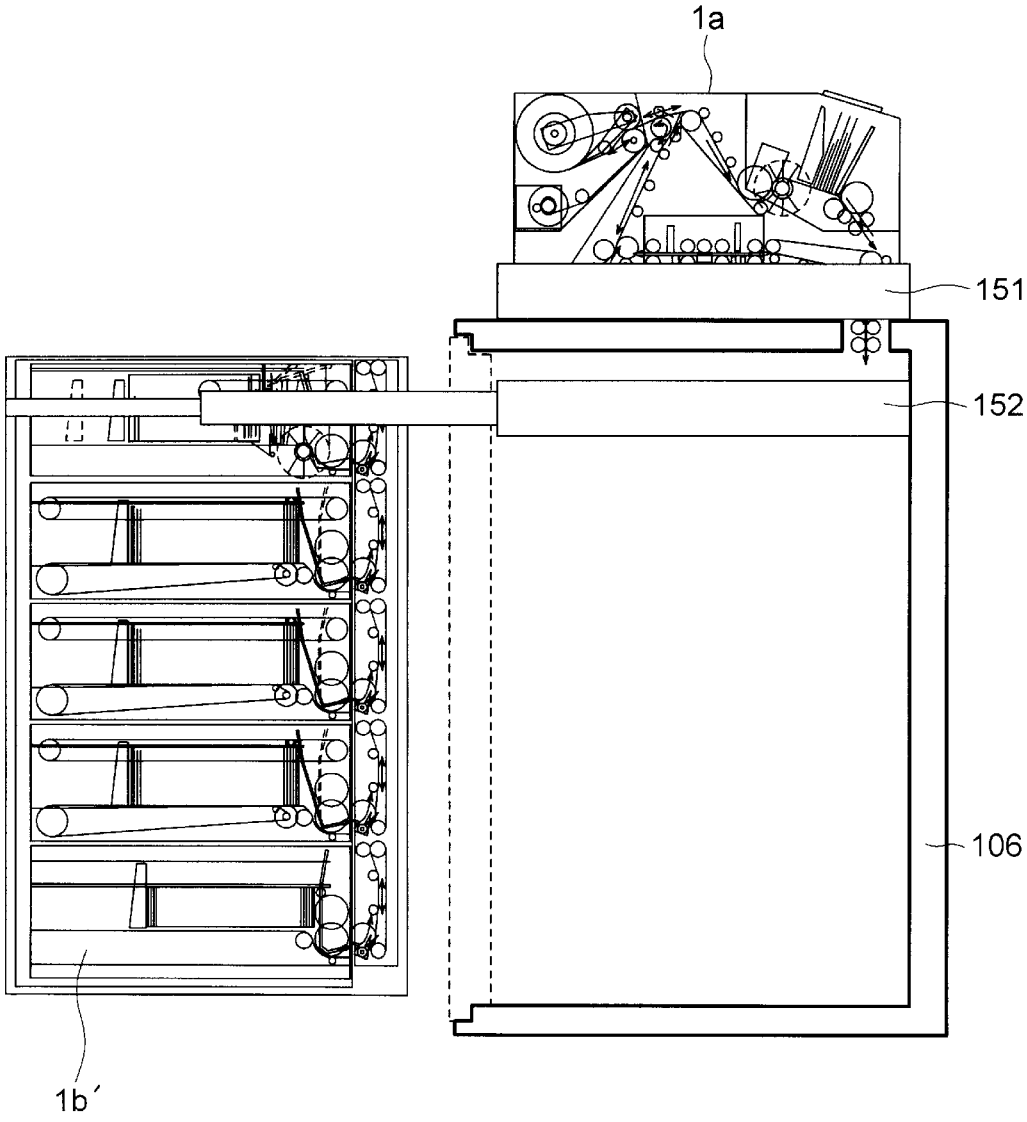
FIG. 8 is a side view where a lower bill mechanism is pulled out backward from the state in FIG. 4.

FIGS. 6 to 8 correspond to the description of FIG. 5, and are side views where the upper bill mechanism 1*a* or the lower bill mechanism 1*b* is pulled out from the bill receiving/dispensing machine 1 included in the automatic teller machine 101. FIG. 6 is a side view where the upper bill mechanism 1*a* is pulled out forward in the state in FIG. 4 (corresponding to FIG. 5A). FIG. 7 is a side view where the upper bill mechanism 1*a* is pulled out backward (corresponding to FIG. 5C). FIG. 8 is a side view where the lower bill mechanism 1*b* is pulled out backward (corresponding to FIG. 5B). In FIGS. 6 to 8 in common, the front of the machine is in a right side of the figure, and the rear of the machine is in a left side of the figure.

Next, features concerning the structure and the control will be further described in detail with reference to FIGS. 9 to 16.

Figure 9:
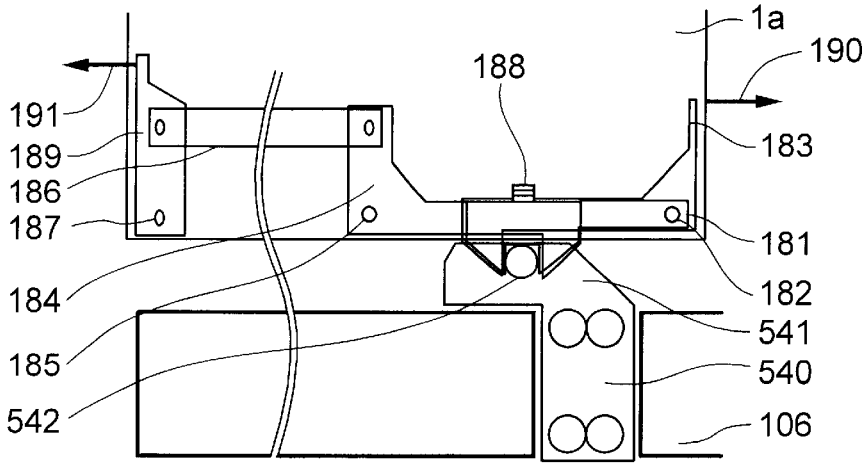
FIG. 9 is a side view explaining a lock mechanism of the upper bill mechanism.

FIG. 9 is a side view explaining the lock mechanism of the upper bill mechanism 1*a*. The upper bill mechanism 1*a* is positioned and locked as described below with respect to a cylindrical lock pin 542 secured to a structural frame 541 of the coupling conveying passage 540 fixedly mounted to the strongbox housing 106.

The upper bill mechanism 1*a* (right side in the figure) is provided with, at the front side thereof, a front lock releasing lever 183 which rotates around a rotation center part or pin 182, and a lock plate 181 rotating around the rotation center 182. The front lock releasing lever 183 engages with the lock pin 542 from backward thereof (see 183*a* in FIG. 11), and the lock plate 181 keeps engaging the lock pin 542 both from forward and backward thereof, so that the upper bill mechanism 1*a* is engaged in a reference position. When the front lock releasing lever 183 is rotated (in an arrow 190 direction) in this state, the lock plate 181 per se is rotated via an upper catch 188 thereof.

The upper bill mechanism 1*a* (left side in the figure) is provided with, at the rear side thereof, a rear lock releasing lever 189 rotating around a rotation center part or pin 187, a rear lock releasing plate 184 rotating around the rotation center part or pin 185, and a coupling link 186 coupling the rear lock releasing lever 189 with the rear lock releasing plate 184. The rear lock releasing plate 184 engages with the lock pin 542 from forward thereof (see 184*a* in FIG. 10), so that the upper bill mechanism 1*a* is engaged in the reference position. When the rear lock releasing lever 189 is rotated in an arrow 191 direction in this state, the rear lock releasing plate 184 is rotated and the lock plate 181 per se is also rotated via the upper catch 188.

In this way, when the front lock releasing lever 183 or the rear lock releasing plate 184 is rotated, the lock plate 181 is also rotated via the upper catch 188 thereof, so that the engagement to the lock pin 542 is released so as to allow the upper bill mechanism 1*a* to be pulled out forward and backward, and that the engagement from forward to the reference position or the engagement from backward to the reference position can be ensured.

Figure 10:
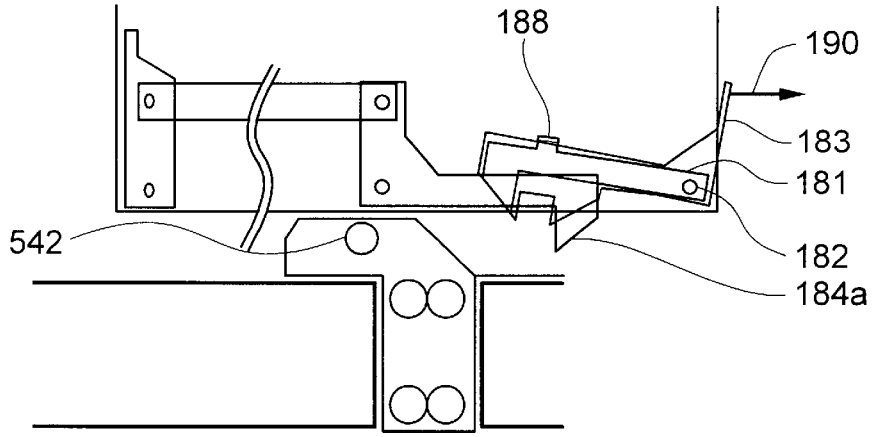
FIG. 10 is an operational view of the lock mechanism when the upper bill mechanism is pulled out forward.

As briefly described above, when the upper bill mechanism 1*a* is pulled out forward, the front lock releasing lever 183 is rotated in the arrow 190 direction as shown in an operation view of the lock mechanism in FIG. 10. This causes not only the rotation of the front lock releasing lever 183 around the pin 182 but also the rotation of the lock plate 181 via the upper catch 188. Therefore, the front lock releasing lever 183 and the lock plate 181 engaging the lock pin 542 are released so as to allow the upper bill mechanism 1*a* to be pulled out in the arrow 190 direction as shown. After there, when the upper bill mechanism 1*a* is moved backward so as to return from the pulled state, a tip 184*a* of the rear lock releasing plate 184 is adapted to engage with the lock pin 542, so that the upper bill mechanism 1*a* stops in the reference position so as not to move further backward from the reference position. A portion abutting on the lock pin 542 of each of the front lock releasing lever 183 and lock plate 181 has a vertical shape on one side thereof and a tapered shape on the other side opposite to the one side (see 183*a* etc.). Thus, it is possible to return the upper bill mechanism 1*a* from the state where the mechanism 1*a* is pulled out forward to the reference position without resistance because of the effect of the tapered shape, while it is devised that it is difficult to pulled out the upper bill mechanism 1*a* from the reference position without rotation of the lever because of the effect of the vertical shape. These shapes also apply to the rear lock releasing plate 184 described below. As shown in the figures, the lock plate 181 has an U-shape (structure), and the front lock releasing lever 183 and the rear lock releasing plate 184 have claw shapes (structures), so as to easily engage the lock pin 542.

Figure 11:
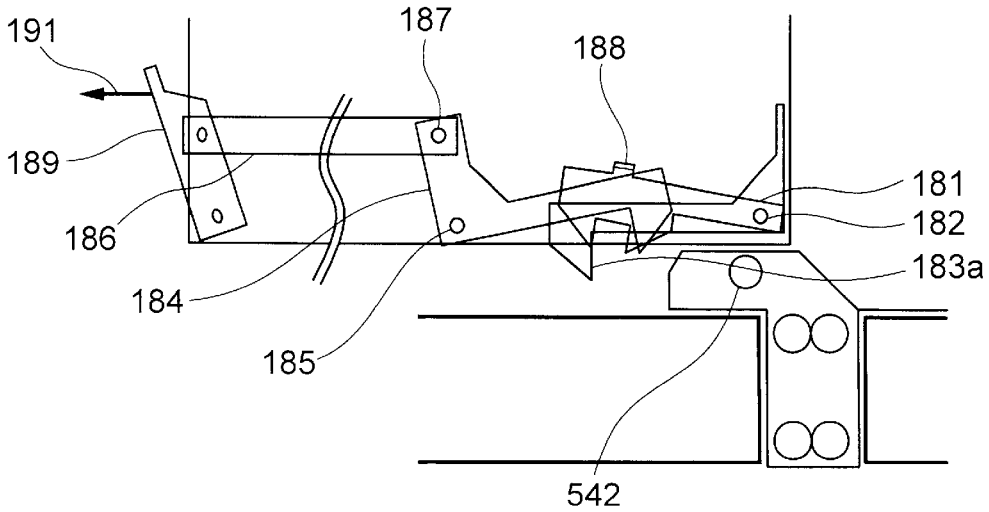
FIG. 11 is an operational view of the lock mechanism when the upper bill mechanism is pulled out backward.

On the other hand, when the upper bill mechanism 1*a* is pulled out backward, as shown in an operational view of the lock mechanism in FIG. 11, the rotation of the rear lock releasing lever 189 in the arrow 191 direction causes the cooperation of a coupling link 186 coupled to the rear lock releasing lever 189, which further causes the rear lock releasing plate 184 coupled to the coupling link 186 to rotates around the pin 185 via the pin 187. The rear lock releasing plate 184 is thereby released upward from the lock pin 542. Then, the rear lock releasing plate 184 contacts with the upper catch 188 in correspondence with rotational movement thereof, so that the lock plate 181 is rotated so as to be released from the lock pin 542. Such rotational and release operations allow the upper bill mechanism 1*a* to be pulled out in the arrow 191 direction (backward of the machine) as shown. Like the above description, also in the case that the upper bill mechanism 1*a* pulled out backward is moved forward, a tip 183*a* of the front lock releasing lever 183 engages with the lock pin 542, so that the upper bill mechanism 1*a* does not move further forward passing through the reference position.

Figure 12:
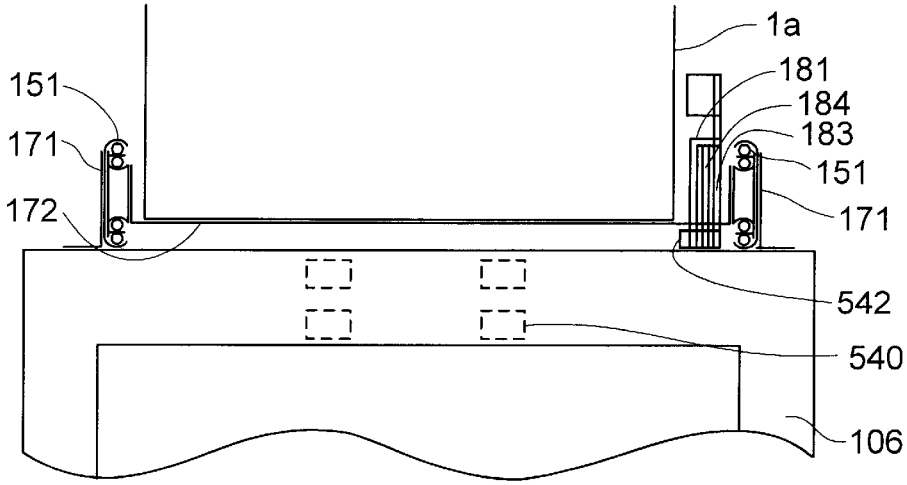
FIG. 12 is a front elevational view explaining the lock mechanism and a drawer mechanism of the upper bill mechanism.

The lock plate 181, the front lock releasing lever 183, the rear lock releasing plate 184 engaging with the lock pin 542 are mounted in the distant side of FIGS. 9 to 11, that is, the right side shown in a front elevational view of the lock mechanism and the drawer mechanism of the upper bill mechanism shown in FIG. 12 (the view of the machine seen from the front thereof). A returning force is applied to each of the lock plate 181, the front lock releasing lever 183, and the rear lock releasing plate 184 by an unshown spring so as to return to each rotational position, while a description thereof is omitted.

As described above, in this embodiment, three parts or units, namely the lock plate 181, the front lock releasing lever 183 and the rear lock releasing plate 184 engage with the lock pin 542 in such a manner that the upper bill mechanism 1*a* can be pulled out both forward and backward of the machine, and secured in a fixed position (reference position) with respect to the coupling conveying passage 540.

As easily presumed by the above description, even if there is not the lock plate 181 among three parts, the upper bill mechanism 1*a* can be theoretically secured in the fixed position with respect to the coupling conveying passage 540 in both operations from the front and rear sides. That is, the engagement with the lock pin 542 can be achieved by the front lock releasing lever 183 and rear lock releasing plate 184 only, and even when the upper bill mechanism 1*a* pulled out in a forward position is returned to the reference position, or when the upper bill mechanism 1*a* pulled out in a backward position is returned to the reference position, the front lock releasing lever 183 and rear lock releasing plate 184 operate so as to prevent the upper bill mechanism 1*a* from moving farther than the reference position.

However, in this embodiment, the lock plate 181 is provided in view of the point that the bills are conveyed between the upper bill mechanism 1*a* and the coupling conveying passage 540. That is, the upper bill mechanism 1*a* and the coupling conveying passage 540 are completely different units, and even a slight positional offset causes a problem in conveying the bills therebetween, and increases a possibility of the bill jam at the offset portion. For this reason, there is a need to realize a mechanism with reduced rattling and offset in view of positional accuracy. If the lock plate 181 is not provided, the rattling among the front lock releasing lever 183, rear lock releasing plate 184 and lock pin 542 is increased due to the accumulated tolerance of the parts. By adding the lock plate 181 which engages the lock pin 542 from both sides as one part in this embodiment, the securing with high accuracy without rattling can be realized. It is needless to say that the same effects can be obtained by adding a lever or the like which releases the lock from the front side and the rear side even if the structure includes the lock plate 181 only.

The structures of above main three parts or units will be briefly described in terms of the functions. The front lock releasing lever 183 (also referred to as a first lock releasing mechanism) has a release function for moving the upper bill mechanism 1*a* forward from the reference position, a function of stopping the upper bill mechanism 1*a* pulled out backward at the reference position when being moved forward (a function of preventing further forward movement from the reference position), and a function of engaging the lock pin 542 in the reference position.

The rear lock releasing plate 184 (also referred to as a second lock releasing mechanism) has a release function for releasing lock to move the upper bill mechanism 1*a* backward from the reference position, a function of stopping the upper bill mechanism 1*a* pulled out forward when being moved backward at the reference position (a function of preventing backward movement passing through the reference position), and a function of engaging the lock pin 542 in the reference position.

The lock plate 181 (also referred to as a third lock releasing mechanism) has a function of releasing lock in the reference position in accordance with the first lock releasing mechanism, a function of releasing lock in the reference position in accordance with the second lock releasing mechanism, and a function of engaging with the lock pin 542 at the reference position.

The lock pin 542 (simply referred to as a locking portion) is a portion with which the first, second and third lock releasing mechanisms engage, and is secured to the housing, frame or the like of the machine. The lock pin 542 therefore has a function of securing the upper bill mechanism 1*a* to the machine, that is, a function of keeping the coupling conveying passage and the conveying passages in the upper bill mechanism in the reference position.

Next, a drawer mechanism for supporting and pulling out the upper bill mechanism 1*a* forward and backward of the machine will be described with reference to FIGS. 12 to 16.

FIG. 12 is a front elevational view seen from the front (left side in FIG. 4), and as shown in the drawing, a drawer rail 151 is mounted on each side of the upper bill mechanism 1*a*. The drawer rail 151 is secured to an upper base 172 below the upper bill mechanism 1*a* and a rail securing fitting 171 on the strongbox housing 106.

Figure 13:
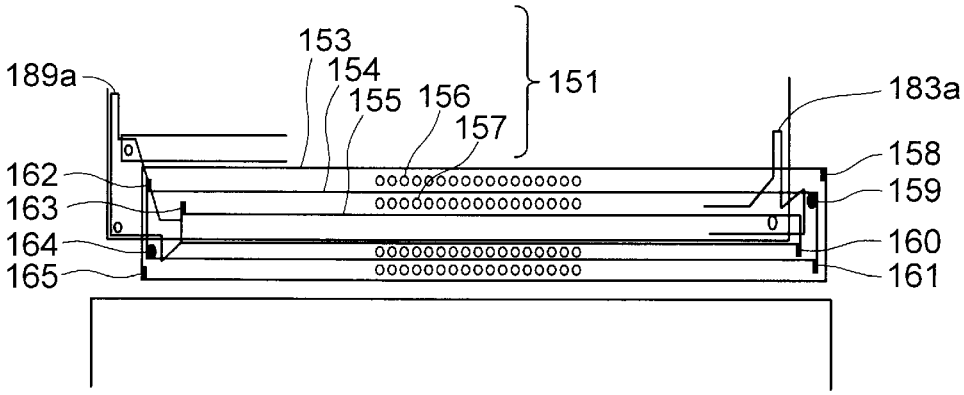
FIG. 13 is a side view explaining the drawer mechanism of the upper bill mechanism.

FIG. 13 is a side view of the drawer rail 151, and shows a state where the upper bill mechanism 1*a* is secured to the reference position of the machine while using the front lock releasing lever 183 and rear lock releasing lever 189 of which shapes are changed.

As shown in the front elevational view of FIG. 12 and the side view of FIG. 13, the drawer rail 151 includes main three rails (also referred to as arms); an outer rail 153 secured to the rail securing fitting 171, an inner rail 155 secured to the upper base 172, and an intermediate rail 154 which is free between the outer rail 153 and inner rail 155. The intermediate rail 154 has a function of relatively changing positions of the outer rail 153 and inner rail 155. For allowing each rail to be pulled, a plurality of steel spheres (steel ball) 156 are provided between the outer rail 153 and intermediate rail 154, and a plurality of steel spheres 157 are provided between the inner rail 155 and intermediate rail 154. In this way, it is the feature to provide three arms for pulling out the upper bill mechanism 1*a* forward and backward of the machine, and if only two arms are provided, an amount of stroke for pulling forward and backward is insufficient to result in preventing the upper bill mechanism 1*a* from being pulled out through the front and rear surfaces of the machine housing, and in causing difficulty in maintenance of the upper bill mechanism 1*a*.

Figure 15:
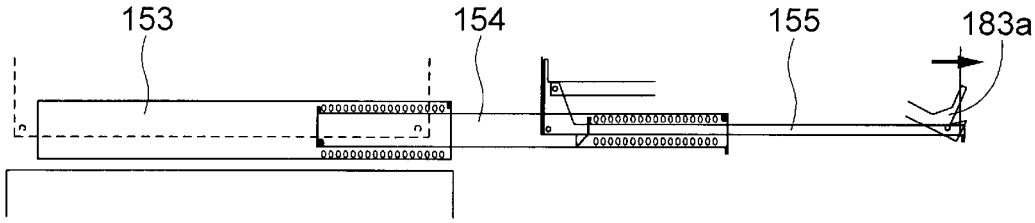
FIG. 15 is an operational view of the drawer mechanism when the upper bill mechanism is pulled out forward.
Figure 16:
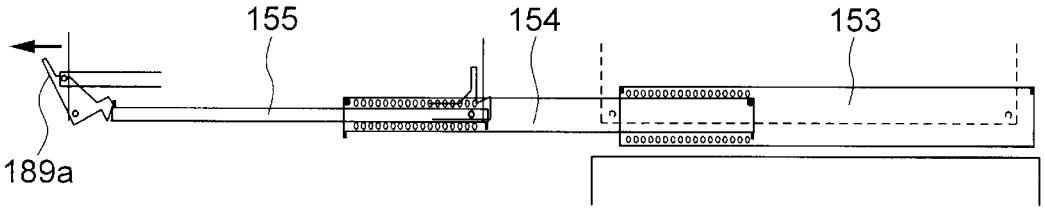
FIG. 16 is an operational view of the drawer mechanism when the upper bill mechanism is pulled out backward.

FIG. 15 shows a state where the upper bill mechanism 1*a* is pulled out forward of the machine, and FIG. 16 shows a state where the upper bill mechanism 1*a* is pulled out backward, and rotational action of the steel spheres 156, 157 permits pulling out the upper bill mechanism 1*a* smoothly toward the front and rear sides. For stable stopping (without detaching of the rails) at a limit of pulling out, eight projections of stoppers 158 to 165 are provided at an end of each of the outer rail 153, inner rail 155, and intermediate rail 154, for permitting stop at positions in FIGS. 15 and 16. The stop positions can be determined in accordance with the number of rigid spheres present between the respective stoppers.

Figure 14:
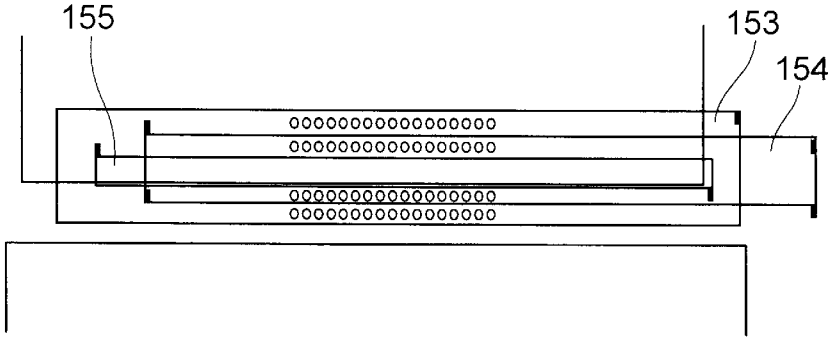
FIG. 14 is a side view explaining a problem of the drawer mechanism of the upper bill mechanism.

Next, when the upper bill mechanism 1*a* is returned from the pulled up state to the state in position (a securing position, or a reference position of the upper bill mechanism 1*a*) in FIG. 13, the intermediate rail 154 sometimes does not return to a regular position such as shown in FIG. 13 only by use of the stoppers 158 to 165, as shown in FIG. 14. That is, even if the inner rail 155 secured to the upper bill mechanism 1*a* is returned to the securing position, the intermediate rail 154 stops while projecting from the machine housing, and thus there has been a problem that the rail is obstructive.

In this embodiment, a manner of accommodating the rail at the time of returning the pulled upper bill mechanism 1*a* to the reference position is devised so as to change the shapes of the front lock releasing lever 183 and the rear lock releasing lever 189 described above. As shown in FIG. 13, a front lock releasing lever plate with an intermediate rail lock 183*a* is therefore provided so as to engage with the front stopper 159 of the intermediate rail 154.

Thus, when the upper bill mechanism 1*a* is returned from the state of being pulled out backward (FIG. 16) to the reference position in FIG. 13, the inner rail 155 which operates in the same manner as the upper bill mechanism 1*a*, and the front lock releasing lever 183*a* provided with an intermediate rail lock 183*a* operate so that the front lock releasing lever plate provided with an intermediate rail lock 183*a* abuts on the stopper 159 provided on the intermediate rail 154, whereby the intermediate rail 154 moves toward the reference position together with the inner rail 155, and finally secured to the reference position as shown in FIG. 13.

When the upper bill mechanism 1*a* in FIG. 15 is returned from the state of being pulled out forward of the machine to the reference position in the FIG. 13, a rear lock releasing lever provided with an intermediate rail lock 189*a* operates together with the inner rail 155, and the rear lock releasing lever provided with an intermediate rail lock 189*a* abuts on the stopper 164, so that the intermediate rail 154 moves toward the reference position together with the inner rail 155 and secured to the reference position in FIG. 13.

In this way, by providing a cooperation mechanism (including the front lock releasing lever plate provided with an intermediate rail lock 183*a*, and the rear lock releasing lever provided with an intermediate rail lock 189*a*), in which the intermediate rail 154 moves together when the inner rail 155 is returned to the reference position, as a structure for returning the upper bill mechanism 1*a* pulled out forward or backward of the machine to the reference position, the intermediate rail 154 is prevented from projecting from the machine housing as in FIG. 14.

As described above, when the upper bill mechanism 1*a* is pulled out, the maintenance person or operator releases the lock by operating the front and rear lock levers, but each lock lever may be structured to have a key, and such a key structure can further increase security.

The key may be a mechanical lock key such as a cylinder lock, but an electrical lock by an electromagnetic solenoid or the like may be mounted and controlled by the controller of the automatic teller machine 101 or bill receiving/dispensing machine 1. By permitting control of lock or release by the controller, for example, the upper bill mechanism 1*a* is usually controlled in such a manner that the lock is released in a backward direction where security is easily ensured, while the upper bill mechanism 1*a* is controlled to be pulled out forward when remaining bills in the upper bill mechanism 1*a* are detected in the deposit transaction. This further ensures security of the machine.

In this way, the bill receiving/dispensing machine 1 (simply referred to as a bill dealing machine), especially the upper bill mechanism 1*a* is structured to be pulled out forward or backward of the machine. This is provided by taking an environment where the machine is located into account. Machines are differently structured depending on environments where the machines are located, for example, whether maintenance of the machine is carried out from the front, from the rear, or from the front and rear of the machine. As the present invention, however, the upper bill mechanism 1*a* allowed to be pulled out forward and backward can accommodate all the environments described above.

Further, by adopting such a configuration, the operation of the machine by the operator mentioned can be carried out.

First, when supplying and collecting (filling up and collecting) of the bill as carried out usually, after opening the rear surface of the machine as shown in FIG. 5B, the lower bill mechanism 1*b* (bill receiving room 60, bill dispensing room 70, recycle room 80, supplying/collecting room 81) are pulled out as shown in FIG. 5C (see FIG. 8), so that the bills can be set or taken out for example, by removing the supplying/collecting room 81. For the bill receiving room 60, bill dispensing room 70, and recycle room 80, the bills can be similarly set or taken out for each storing portion.

Next, operation by the operator will be described when a failure occurs during the bill receiving and dispense transactions.

In the deposit transaction, the user inserts the bills in the bill receiving/dispensing port 20, but there is a possibility that the bills are folded or broken, or that foreign matters other than the coins and bills are inserted. The deposit transaction starts even in such a case, and the bills are separated one by one from the bill receiving/dispensing port 20. The kinds and genuineness of the bills are identified in the bill identifying portion 30, and the bills of which kinds are identified are held in the temporary storing room 40. The bills of which kinds could not have been identified are returned to the bill receiving/dispensing port 20 as reject bills.

If the unfavorable bills or foreign matters are caught in the bill conveying passage or the like so as to cause a jam during the process, the controller detects the remaining jam of the bills and reports "jam failure in the upper bill mechanism 1*a* in the deposit transaction" to stop the transaction. The operator has to remove the jammed bills in the upper bill mechanism 1*a* in accordance with the report, and to return all the bills to the user. Therefore, the operator pulls out the upper bill mechanism 1*a* from the front of the machine as shown in FIG. 5A (see FIG. 6), checks the bill receiving/dispensing port 20, bill identifying portion 30, temporary storing room 40, and upper bill conveying passages 501*a*, 501*b*, 501*c*, 501*d*, 501*e*, 501*h*, removes all the remaining bills, and returns them to the user.

Then, the operator returns the upper bill mechanism 1*a* into the strongbox housing 106, and after rebooting the machine, advises the user to carry out the transaction again. In this operation, the upper bill mechanism 1*a* is pulled out toward the user side in the front, so that the bills can be quickly returned to the user, which is superior in service.

In the dispense transaction, the bills fed one by one from the recycle room 80 or bill dispensing room 70 for each kind of the bill are subjected to identification of the kinds in the bill identifying portion 30, and accumulated in the bill receiving/dispensing port 20 to be collectively paid to the user. However, in the same way as the deposit transaction, when the jam occurs in the feeding portion or conveying portion, the controller detects a jam occurrence position and reports the jam failure so as to stop the transaction.

The operator has to remove the jammed bills in the upper bill mechanism 1*a* or lower bill mechanism 1*b* in correspondence with the report. Therefore, as shown in FIG. 5C, the operator opens the rear door 101*e*, pulled out the upper bill mechanism 1*a* or lower bill mechanism 1*b* (see FIGS. 7, 8), and removes the jammed bills in the conveying passages. When the jammed bills are both in the upper bill mechanism 1*a* and lower bill mechanism 1*b*, maintenance from the rear is safe in comparison with that from the user side in the front of the machine since the lower bill mechanism 1*b* (the bill dispensing room 70 or the recycle room 80) holds a large amount of bills, which is superior in security.

As described above, according to the invention, the bill receiving/dispensing machine which provides against not only usual supply and collection of the bills to and from the bill storing rooms but also both service of a quick response to the user and security in cash control in view of the operator's operation when the failure such as the bill jam occurs during the user operation, thereby it is possible to select the operation from the front or rear surface of the machine depending on the transaction and the state of the failure.

It will be further understood by those skilled in the art that the foregoing description has been made on embodiments of the invention and that various changes and modifications may be made in the invention without departing from the spirit of the invention and scope of the appended claims.

What is claimed is:

1. A bill receiving/dispensing machine for receiving or dispensing a bill, comprising:

a housing;

an upper unit disposed in the upper part of the bill receiving/dispensing machine;

a lower unit disposed in the lower part of the bill receiving/dispensing machine;

a receiving/dispensing port for receiving a bill inserted by a user or dispensing a bill to a user, which is provided in said upper unit;

a bill identifying portion for identifying a bill, which is provided in said upper unit;

a temporary storing room for storing the inserted bill temporarily, which is provided in said upper unit;

an upper bill conveying passage extending in said upper unit and passing through said bill identifying portion;

a bill storing room for storing the inserted bill and/or the bill to be dispensed, which is provided in said lower unit;

a lower bill conveying passage extending in said lower unit;

a front operating portion for pulling out said upper unit toward the front side of the bill receiving/dispensing machine;

a rear operating portion for pulling out said upper unit toward the rear side of the bill receiving/dispensing machine; and a locking portion fixed to said housing; wherein said front and rear operating portions can be locked at said locking portion, so that said upper and lower bill conveying passages are connected with each other to establish the connection between said receiving/dispensing port and said bill storing room.

2. The bill receiving/dispensing machine according to claim 1, wherein said front operating portion comprises a first lock releasing mechanism for locking said upper unit at said locking portion and releasing the lock when pulling out said upper unit to a front side of the bill receiving/dispensing machine, and said rear operating portion comprises a second lock releasing mechanism for locking said upper unit at said locking portion and releasing the lock when pulling out said upper unit to a rear side of the bill receiving/dispensing machine.

3. The bill receiving/dispensing machine according to claim 2, wherein said first lock releasing mechanism comprises a front lock releasing lever disposed on the front side of the bill receiving/dispensing machine, and said second lock releasing mechanism comprises a rear lock releasing lever disposed on the rear side of the bill receiving/dispensing machine, a rear lock releasing plate which locks said upper unit at said locking portion and releases the lock, and a link which connects said rear lock releasing lever with said lock releasing plate.

4. The bill receiving/dispensing machine according to claim 3, wherein said front lock releasing lever has a claw structure which is hooked on said locking portion at its one side, and said rear lock releasing plate has a claw structure which is hooked on said locking portion at its other side.

5. The bill receiving/dispensing machine according to claim 4, wherein each of the claw structures of said front lock releasing lever and said rear lock releasing plate has a tapered shape and a vertical shape at an abutting portion on said locking portion with respect to the locking portion.

6. The bill receiving/dispensing machine according to claim 2, further comprising a third lock releasing mechanism which is released from said locking portion by releasing said first lock releasing mechanism from said locking portion, and is released from said locking portion by releasing said second lock releasing mechanism from said locking portion.

7. The bill receiving/dispensing machine according to claim 6, wherein said third lock releasing mechanism comprises a lock plate having an U-shaped structure which locks said locking portion from both sides.

8. The bill receiving/dispensing machine according to claim 7, wherein said lock plate is of a vertical shape at an engaging portion with said locking portion and of a tapered shape at a portion not engaging with said locking portion.

9. The bill receiving/dispensing machine according to claim 2, wherein each of said first and second lock releasing mechanisms has a cylinder lock structure.

10. The bill receiving/dispensing machine according to claim 2, wherein each of said first and second lock releasing mechanisms has a electrical lock structure, and the bill receiving/dispensing machine comprises a controller which controls the release of said second releasing mechanism in a normal mode, and controls the release of said first lock releasing mechanism in a deposit transaction mode where a bill is inserted from said bill receiving/dispensing port.

11. The bill receiving/dispensing machine according to claim 1, wherein a connecting conveying passage for connecting said upper bill conveying passage with said lower bill conveying passage is arranged between said upper unit and said lower unit, and wherein said upper bill conveying passage in said upper unit is locked at said locking portion by using said front operating portion and said rear operating portion so as to be connected with said connecting conveying passage.

12. The bill receiving/dispensing machine according to claim 6, wherein said third lock releasing mechanism engages with said locking portion so that said upper unit are locked up with respect to said housing of the bill receiving/dispensing machine at a reference position.

13. The bill receiving/dispensing machine according to claim 1, wherein said lower unit is accommodated in a strongbox housing made of an iron plate thicker than that of a housing which protects said upper unit.

14. The bill receiving/dispensing machine according to claim 1, further comprising a mechanism for pulling out the lower unit toward the back side of said bill receiving/dispensing machine.

15. The bill receiving/dispensing machine according to claim 2, wherein said upper unit is stopped at the reference position by said second lock releasing mechanism when said upper unit pulled out to the front side of the machine is returned to the reference position, or said upper unit is stopped at the reference position by said first lock releasing mechanism when said upper unit pulled out to the rear side of the machine is returned to the reference position.

16. The bill receiving/dispensing machine according to claim 6, wherein said upper unit is stopped at the reference position by said third lock releasing mechanism when said upper unit pulled out to the front side or the rear side of the machine is returned to the reference position.

17. The bill receiving/dispensing machine according to claim 1, further comprising at least three drawer mechanisms for pulling out said upper unit to the front side and the rear side of said bill receiving/dispensing machine, wherein said three drawer mechanisms comprise a first drawer mechanism mounted to said upper unit, a second drawer mechanism mounted to the housing of said bill receiving/dispensing machine, and a third drawer mechanism which dynamically connects said first drawer mechanism and said second drawer mechanism.

18. The bill receiving/dispensing machine according to claim 17, further comprising:

a first lock mechanism which locks said third drawer mechanism so as not to be detached from said second drawer mechanism; and a second lock mechanism which locks said first drawer mechanism so as not to be detached from said third drawer mechanism.

19. The bill receiving/dispensing machine according to claim 17, further comprising a returning mechanism which returns said third drawer mechanism to said reference position together with said first drawer mechanism when said upper unit pulled out toward the front or rear side of said bill receiving/dispensing machine is returned to the reference position.

20. A bill receiving/dispensing machine for receiving or dispensing a bill, comprising:

a receiving/dispensing port which operates as an inlet for receiving a bill or an outlet for dispensing a bill;

a storing portion for storing the bill inserted from said receiving/dispensing port or a bill to be dispensed from said receiving/dispensing port;

an identifying portion for identifying the bill inserted from said receiving/dispensing port or the bill fed from said storing portion; and a controller for controlling a deposit transaction so that the bill inserted from said receiving/dispensing port is identified in said identifying portion and stored in said storing portion in correspondence with the identification result, and for controlling a dispense transaction so that the bill fed from said storing portion is identified in said identifying portion and dispensed from said receiving/dispensing port in correspondence with the identification result, wherein an upper bill mechanism which comprises said receiving/dispensing port and said bill identifying portion is located in an upper portion of said bill receiving/dispensing machine, and a lower bill mechanism which comprises said storing portions is located in a lower portion of said bill receiving/dispensing machine, said upper bill mechanism and said lower bill mechanism are structurally divided, and said bill receiving/dispensing machine further comprises;

a locking portion which secures said upper bill mechanism to said bill receiving/dispensing machine;

a first lock releasing mechanism for securing said upper bill mechanism to said locking portion and for releasing said upper bill mechanism from said locking portion so as to pull out said upper bill mechanism toward the front side said bill receiving/dispensing machine; and a second lock releasing mechanism for securing said upper bill mechanism to said locking portion and for releasing said upper bill mechanism from said locking portion so as to pull out said upper bill mechanism to the rear side of said bill receiving/dispensing machine.

21. The bill receiving/dispensing machine according to claim 20, further comprising a third lock releasing mechanism for securing said upper bill mechanism to said locking portion, wherein said third lock releasing mechanism is released from said locking portion when said first lock releasing mechanism is released, and is released from said locking portion when said second lock releasing mechanism is released.

22. The bill receiving/dispensing machine according to claim 20, wherein said controller controls said first lock releasing mechanism so as to be released from said locking portion when a failure occurs in said deposit transaction, or controls said second lock releasing mechanism so as to be released from said locking portion when a failure occurs in said dispense transaction.

23. The bill receiving/dispensing machine according to claim 20, wherein said controller reports so as to pull out said upper bill mechanism to the front side of said bill receiving/dispensing machine when a failure occurs in said deposit transaction, or reports so as to pull out said upper bill mechanism to the rear side of said bill receiving/dispensing machine when a failure occurs in said dispense transaction.

24. The bill receiving/dispensing machine according to claim 20, further comprising a drawer mechanism which pulls out said upper bill mechanism to the front and rear sides of said bill receiving/dispensing machine, wherein said drawer mechanism comprises a first drawer mechanism mounted on said upper bill mechanism, a second drawer mechanism mounted on said bill receiving/dispensing machine, and a third drawer mechanism which relatively moves said first drawer mechanism and said second drawer mechanism.

25. A bill receiving/dispensing machine for dealing with a bill, comprising:

a receiving/dispensing port for receiving an inserted bill or sending out a bill outside the bill receiving/dispensing machine;

a storing room for storing the bill inserted from said receiving/dispensing port or the bill to be fed to said receiving/dispensing port;

a conveying passage for conveying the bill, which connects said receiving/dispensing port with said storing room;

an identifying portion located on said conveying passage for identifying the bill inserted from said receiving/dispensing port; and a temporary storing room for temporarily storing the bill inserted from said receiving/dispensing port, wherein:

said bill receiving/dispensing machine has a divided structure having an upper unit located in an upper portion and a lower unit located in a lower portion, said conveying passage has a divided structure having an upper conveying passage located in the upper portion and a lower conveying passage located in the lower portion, said upper unit comprises said receiving/dispensing port, said bill identifying portion, said temporary storing room, and said upper conveying passage, and said lower unit comprises plurality of said bill storing rooms and said lower conveying passage, wherein said plurality of storing rooms are stacked along said lower conveying passage arranged vertically, and said bill receiving/dispensing machine further comprises:

a mechanism which secures said upper unit at a reference position with respect to said bill receiving/dispensing machine in regular operation of said bill receiving/dispensing a mechanism which pulls out said upper unit from said reference position both forward and backward with respect to said bill receiving/dispensing machine in maintenance operation of said bill receiving/dispensing machine;

a first engaging mechanism which secures said upper unit at said reference position when said upper unit is pulled out to a front side of said bill receiving/dispensing machine is returned to said reference position; and a second engaging mechanism which secures said upper unit at said reference position when said upper unit is pulled out to a rear side of said bill receiving/dispensing machine is returned to said reference position.

26. The bill receiving/dispensing machine according to claim 25, wherein said first engaging mechanism comprises a lock pin mounted to a frame of said bill receiving/dispensing machine, a rear lock releasing plate which is operated from a rear side of said bill receiving/dispensing machine for carrying out the lock to said lock pin and the release from said lock pin, and a lock plate for carrying out the lock to said lock pin and the release from said lock pin in association with said rear lock releasing plate, and said second engaging mechanism comprises said lock pin, a front lock releasing lever which is operated from a front side of said bill receiving/dispensing machine for carrying out the lock to said lock pin and the release from said lock pin, and said lock plate for carrying out the lock to said lock pin and the release from said lock pin in association with said front lock releasing lever.

27. The bill receiving/dispensing machine according to claim 25, further comprising a connecting conveying passage which is arranged between said upper unit and said lower unit, and connects said upper conveying passage and said lower conveying passage.

* * * * *